US011946263B2

(12) United States Patent
McDow, Jr. et al.

(10) Patent No.: US 11,946,263 B2
(45) Date of Patent: Apr. 2, 2024

(54) ROOF VENT WITH CONTOURED FOOT

(71) Applicants: William Archie McDow, Jr., Tallassee, AL (US); David Campbell McDow, Montgomery, AL (US)

(72) Inventors: William Archie McDow, Jr., Tallassee, AL (US); David Campbell McDow, Montgomery, AL (US)

(73) Assignee: Golden Rule Fasteners, Inc., Tallassee, AL (US)

( * ) Notice: Subject to any disclaimer, the term of this patent is extended or adjusted under 35 U.S.C. 154(b) by 0 days.

(21) Appl. No.: 17/135,255

(22) Filed: Dec. 28, 2020

(65) Prior Publication Data

US 2022/0205254 A1 Jun. 30, 2022

(51) Int. Cl.

| | |
|---|---|
| ***E04F 17/02*** | (2006.01) |
| ***E04D 13/17*** | (2006.01) |
| ***E04F 17/04*** | (2006.01) |
| *E04D 1/30* | (2006.01) |

(52) U.S. Cl.

CPC ..... *E04F 17/026* (2013.01); *E04D 13/17* (2013.01); *E04F 17/04* (2013.01); *E04D 2001/309* (2013.01)

(58) Field of Classification Search

CPC ... F24F 7/02; F24F 7/04; E04F 17/026; E04F 17/04; E04D 13/17; E04D 2001/309

See application file for complete search history.

(56) References Cited

U.S. PATENT DOCUMENTS

| | | | | | |
|---|---|---|---|---|---|
| 226,625 | A | * | 4/1880 | Pardessus | E04D 13/0325 454/199 |
| 288,536 | A | | 11/1883 | Williams | |
| 1,080,137 | A | | 12/1913 | Carter | |
| 2,806,419 | A | | 9/1957 | Artis | |
| 2,985,091 | A | | 5/1961 | Hatcher | |
| 3,302,551 | A | | 2/1967 | Van Belle | |
| 3,521,414 | A | * | 7/1970 | Malissa | E04D 13/031 52/107 |
| 3,783,767 | A | | 1/1974 | Stalker | |
| 3,984,947 | A | | 10/1976 | Patry | |
| 4,333,660 | A | * | 6/1982 | Cupit | E04D 13/1476 277/630 |
| 4,437,687 | A | * | 3/1984 | Wilson | E04D 13/1407 285/136.1 |
| 4,480,534 | A | * | 11/1984 | Sloan | B65D 88/741 454/182 |
| 4,570,396 | A | * | 2/1986 | Struben | E04B 7/00 52/199 |
| 4,664,390 | A | * | 5/1987 | Houseman | E04D 13/1476 277/606 |

(Continued)

FOREIGN PATENT DOCUMENTS

| | | | | | |
|---|---|---|---|---|---|
| FR | 3103505 | A1 | * | 5/2021 | E04G 21/241 |
| GB | 311105 | A | * | 5/1929 | F24F 7/02 |

(Continued)

*Primary Examiner* — Adriana Figueroa

(74) *Attorney, Agent, or Firm* — Rozier Hardt McDonough PLLC

(57) ABSTRACT

A roof vent for a contoured metal surface. The roof vent includes a base or foot having one or more recessed channels that extend between opposing edges of the foot. The recessed channels are sized and shaped to receive correspondingly shaped ridges of the contoured metal roof surface.

15 Claims, 8 Drawing Sheets

(56) References Cited

U.S. PATENT DOCUMENTS

| | | | | |
|---|---|---|---|---|
| 5,053,266 | A * | 10/1991 | Hesketh | E04D 1/30 428/192 |
| 5,662,522 | A | 9/1997 | Waltz | |
| 7,114,301 | B2 * | 10/2006 | Bibaud | E04D 13/1476 52/219 |
| 9,457,304 | B2 | 11/2015 | Bourque et al. | |
| 10,723,547 | B2 * | 7/2020 | Forrest | E04D 13/17 |
| 2005/0252111 | A1 * | 11/2005 | Prenn | E04D 13/1476 52/200 |
| 2007/0220819 | A1 * | 9/2007 | Neuschafer | F24F 7/02 52/219 |
| 2012/0073239 | A1 * | 3/2012 | Haines | F24F 7/02 52/745.21 |
| 2020/0181916 | A1 * | 6/2020 | Leinbach | E04D 13/14 |

FOREIGN PATENT DOCUMENTS

| | | | |
|---|---|---|---|
| GB | 1082668 | A | 9/1967 |
| GB | 2052044 | A | 1/1981 |
| JP | 07074521 | B2 | 8/1995 |
| WO | 2019208899 | A1 | 10/2019 |

* cited by examiner

--PRIOR ART--

--PRIOR ART--

ROOF VENT WITH CONTOURED FOOT

FIELD

The present disclosure is directed to vents for covering openings on metal roofs. More particularly, the disclosure relates to vents that cover openings on contoured (e.g., corrugated) metal roofs, preventing moisture and objects from entering the opening while allowing air to pass therethrough. The vents include a cap, a collar, and a contoured foot configured to contact a correspondingly contoured roof surface.

BACKGROUND

Vents are often used on roofs, both commercial and residential, to release heat, steam and/or other gases to the atmosphere. Some examples are vents for agricultural and industrial buildings, bathroom vents, laundry room exhaust vents, and kitchen range vents. Such vents may include a cap; a screen to prevent rain, insects, and other pests from entering the vent; and a flashing to interface with the roof. Various materials are used to form such vents, including various plastics, metals, and rubber materials. Securely attaching such vents to a metal roof presents several challenges. For example, the attachment method must be secure enough to withstand wind and other environmental factors. More problematic, the vent must be attached to the roof in a manner that prevents moisture, etc., from entering the building through the points at which the vent is secured to the roof.

Metal roofs are often constructed of overlapping corrugated metal panels attached to a roof deck. Each corrugated panel typically includes of a series of web or pan sections separated by a series of raised ribs or ridges. The raised ridges generally have a geometric cross-section (e.g., trapezoidal, triangular, arcuate, etc.) such that they are self-supporting. Each corrugated panel typically starts and ends with a ridge. When assembled to form a roof covering, a starting ridge of a newly installed panel overlaps on the ending ridge of the panel already in place.

Pre-existing roof vents designed for shingle roof applications are difficult to install on metal roofs and perform poorly when they are installed because they are designed to integrate with a shingle roof system. In a shingle roof system, a generally flat flange portion of the vent is installed underneath roofing shingles. Pre-existing adapters allow these shingle-roof vents to be installed on a metal roof, but the adapters are large and create an unsightly appearance with their expanded footprint on top of the metal roof. Further, the contoured (e.g., corrugated) surface of the metal roof makes it difficult to waterproof an interface between a vent and the metal roof surface without such an adaptor.

SUMMARY

The present disclosure resolves the several problems associated with prior roof vents when utilized with a contoured metal roof. The roof vents include a base or foot having one or more recessed channels that extend between opposing edges of a bottom surface of the base or foot (hereafter foot). The recessed channels are sized and shaped to receive correspondingly shaped ridges of an underlying contoured metal roof surface. Accordingly, the foot of the roof vent may be selected to match a contour (e.g., ridge configuration) of a specific metal roof. In any arrangement, the foot of the vent will include an aperture extending through the foot within its periphery. A collar, which may be attached to an upper surface of the foot or integrally formed with the foot, surrounds a periphery of the aperture. The collar, which may be an annular sidewall with a hollow interior, prevents water (e.g., on a top surface of the vent) from entering into the aperture and an underlying opening in a roof surface. The vents may further include a cap that prevents water from entering into the hollow interior of the collar. The vents described herein lower installation time and cost while providing a more secure and weather resistant attachment to a roof.

DETAILED DESCRIPTION

Reference will now be made to the accompanying drawings, which at least assist in illustrating the various pertinent features of the presented inventions. The following description is presented for purposes of illustration and description and is not intended to limit the inventions to the forms disclosed herein. Consequently, variations and modifications commensurate with the following teachings, and skill and knowledge of the relevant art, are within the scope of the presented inventions. The embodiments described herein are further intended to explain the best modes known of practicing the inventions and to enable others skilled in the art to utilize the inventions in such, or other embodiments and with various modifications required by the particular application(s) or use(s) of the presented inventions.

Figures 1A, 1B:
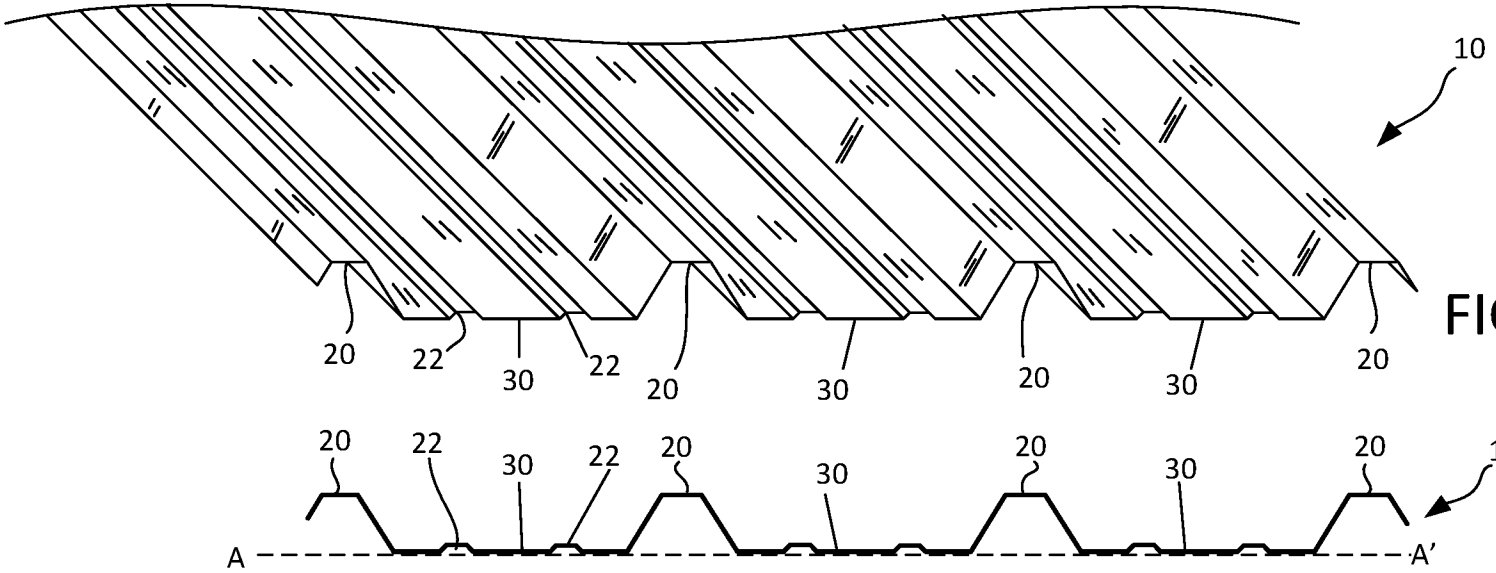
FIGS. 1A-1E illustrate various configurations of metal roofing panels.
Figure 1C:
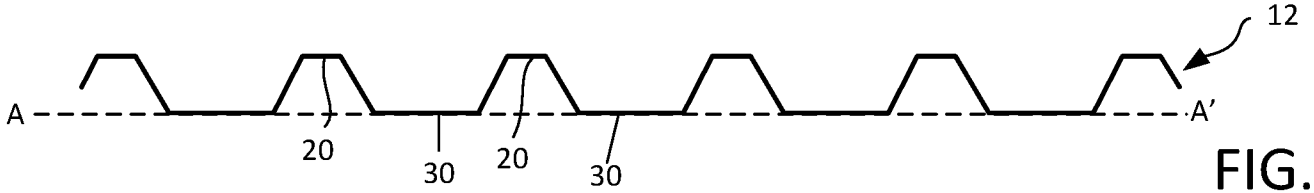
Figure 1D:
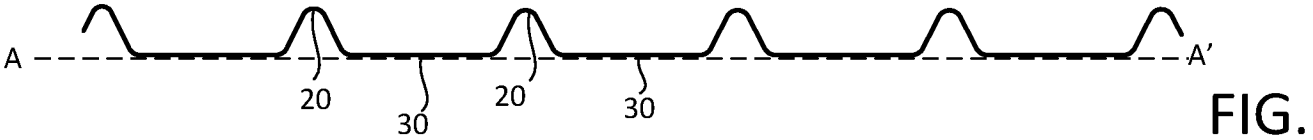
Figure 1E:
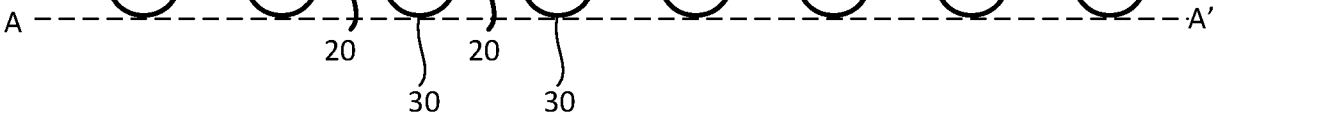

FIGS. 1A and 1B illustrates perspective and cross-sectional views, respectively, of one exemplary embodiment of a section of a corrugated metal roof panel 10, which in the present embodiment includes a plurality of parallel raised ridges or ribs 20, each having a generally trapezoidal shape, separated by generally flat pan sections 30. As illustrated, the lower surfaces of the pan sections 30 are typically disposed in a common plane A-A' to allow the panel to be attached to a generally flat roof deck. The illustrated corrugated metal roof panel 10 starts and ends with a ridge 20 and may include partial pan sections outside of the starting and ending ribs/ridges (not shown). When multiple panels are assembled on a roof deck, to form a roof covering, a starting ridge of a newly installed panel overlaps on the ending ridge of a panel already in place, thereby providing a gravity borne mechanical seal. Such construction is well known to those skilled in the art. In the illustrated embodiment, the pan sections 30 between the ridges 20 include smaller pan section ridges 22 to improve the structural integrity of the panel. In such an arrangement, the pan section ridges 22 are typically shorter than the main or primary ridges 20. The illustrated configuration where the panel has two trapezoidal-shaped pan section ridges 22 disposed between each pair of adjacent primary ridges is sometimes referred to as an R-type panel or an R-panel. As discussed below, exemplary metal roof vents are disclosed that utilize a foot or base having a contour similar the R-type panel illustrated in FIGS. 1A and 1B. However, it will be understood that the embodiments and figures disclosed herein of a vent having a foot with an R-type panel contour are to be considered illustrative rather than limiting. Further, it will be appreciated that numerous types of contoured/corrugated metal roof panels exist and that the disclosed metal roof vents may utilize a foot contour that corresponds to any such metal panel. By way of example, FIG. 1C illustrates what is sometimes referred to as a U-panel 12 having a series of repeating trapezoidal ribs/ridges 20 separated by flat pan sections 30. By way of further example, FIG. 1D illustrates what is sometimes referred to as an AP-panel 14 having a series of triangular ribs/ridges 20 separated by flat pan sections 30. FIG. 1D illustrates a panel 16 having a series of arcuate ribs 20 separated by arcuate pan sections 30. In all embodiments, the lower surfaces of the pan sections 30 are disposed in a common plane A-A' to allow the panel to be attached to a generally flat roof deck. The metal roof vents disclosed herein may incorporate a base or foot contour that corresponds to these and additional metal panels.

Figure 2B:
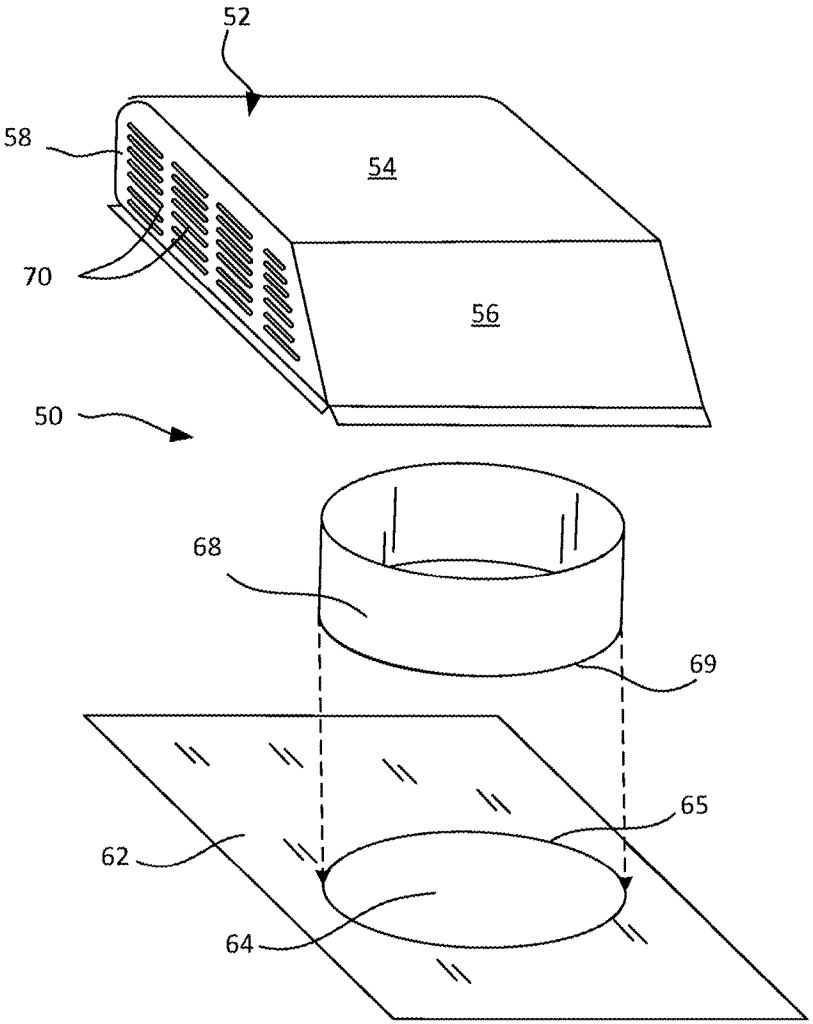
FIGS. 2A and 2B illustrate one prior art roof vent.
Figure 2A:
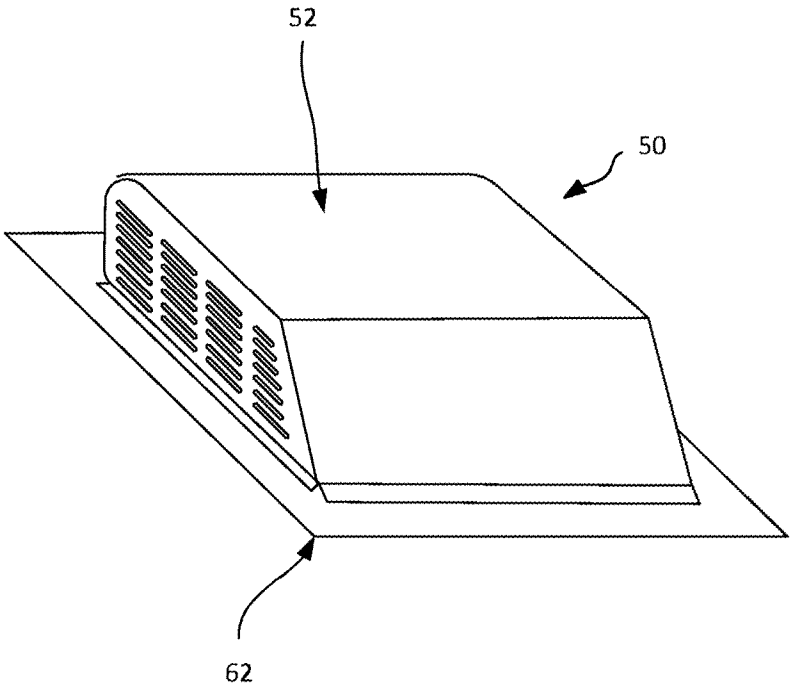

FIGS. 2A and 2B illustrate one exemplary prior art roof vent 50 utilized to cover an opening on a roof while preventing moisture from entering through the opening. As shown, the vent 50 includes a cap 52, a base or foot 62 and a collar 68. When assembled, the cap 52 is attached to an upper surface of the foot 62 and surrounds the collar 68. The cap 52, foot 62 and collar 68 can be formed of a variety of metals or other materials. Such materials include, without limitation, plastic, nylon, aluminum, steel, or various other rigid materials. In the illustrated embodiment, the cap 52 includes an upper wall/surface 54 and four walls extending from a perimeter of the upper surface 54. Specifically, the cap 52 includes a front wall (not shown), a sloping rear wall 56 and two sidewalls 58 (only one shown), which extend between the front and rear walls. A plurality of vent slits 70 may be formed through one or more of the walls of the cap 52. The slits allow for air to pass through the vent 50. Although the slits 70 are illustrated in a rectangular shape, it is understood that the slits 70 can be formed in a variety of shapes, including circular, square, etc. More or fewer slits can also be used depending on desired airflow. The upper surface and sidewalls of the cap 52 define a generally hollow interior that extends over the collar 68, when the vent is assembled, to prevent moisture from passing through the collar 68. In an alternate embodiment (not shown), the cap may not include any slits. In such an embodiment, the cap may be spaced above the surface of the foot and connected to the collar. Such an alternate cap arrangement is disclosed in co-owned U.S. patent application Ser. No. 16/676,897, the entire contents of which are incorporated herein by reference.

The foot 62 is typically made of a flat piece of material (e.g., sheet metal) having substantially planer top and bottom surfaces. The foot includes an aperture 64 that is configured for positioning over an opening in a roof surface. The illustrated collar 68 forms an annular sidewall having a hollow interior and having a lower edge 69 that attaches about the periphery 65 of the aperture 64 in the foot 62. More specifically, the bottom edge of the collar 68 is affixed such that the interface between the collar 68 and the foot 62 is sealed. In this regard, any water passing over a top surface of the foot is prevented from entering the aperture 64 and an underlying opening in a roof surface. Though illustrated as being separate parts, it will be appreciated that the collar may be integrally formed with the foot, for example, in a stamping process.

The foot 62 includes a generally flat or planer bottom surface that can be affixed to a surface of a metal roof utilizing, for example, roof screws passing through the foot into an underlying surface of the metal roof. A rubberized gasket or a sealant such as silicone may be disposed between the foot and the roof. Once affixed to the surface of a metal roof over an opening in the roof, air may pass through the vent via the collar 68 and spaced between the collar 68 and the cap 52. However, difficulties arise when attempting to utilize the vent 50 on a metal roof that is corrugated or otherwise includes a plurality of ridges/ribs (e.g., a contoured surface). Specifically, it is difficult to effectively seal the planar bottom surface of the foot to a contoured surface.

Figure 3:
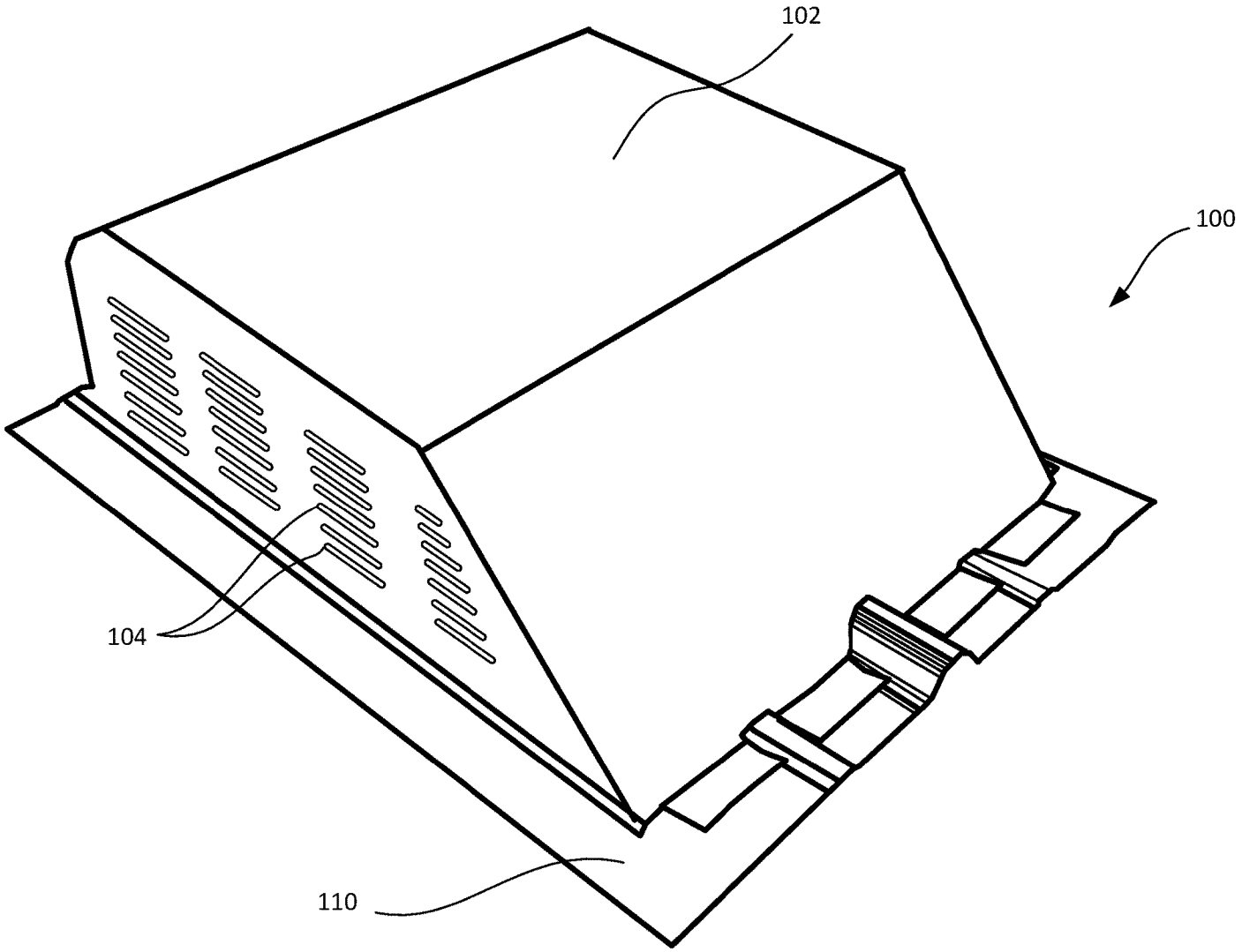
FIG. 3 illustrates a roof vent in accordance with the present disclosure.
Figure 4B:
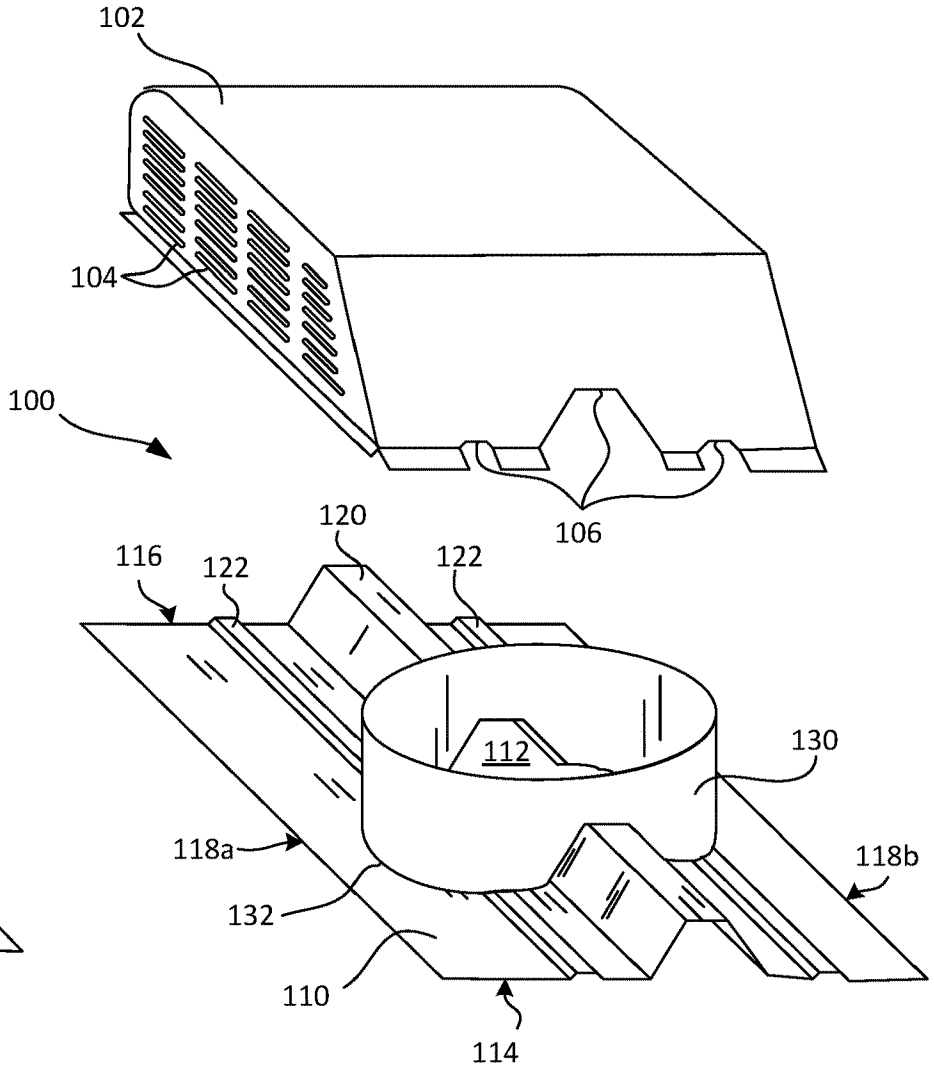
FIGS. 4A and 4B illustrate assembled and exploded views of the roof vent of FIG. 3.
Figure 4A:
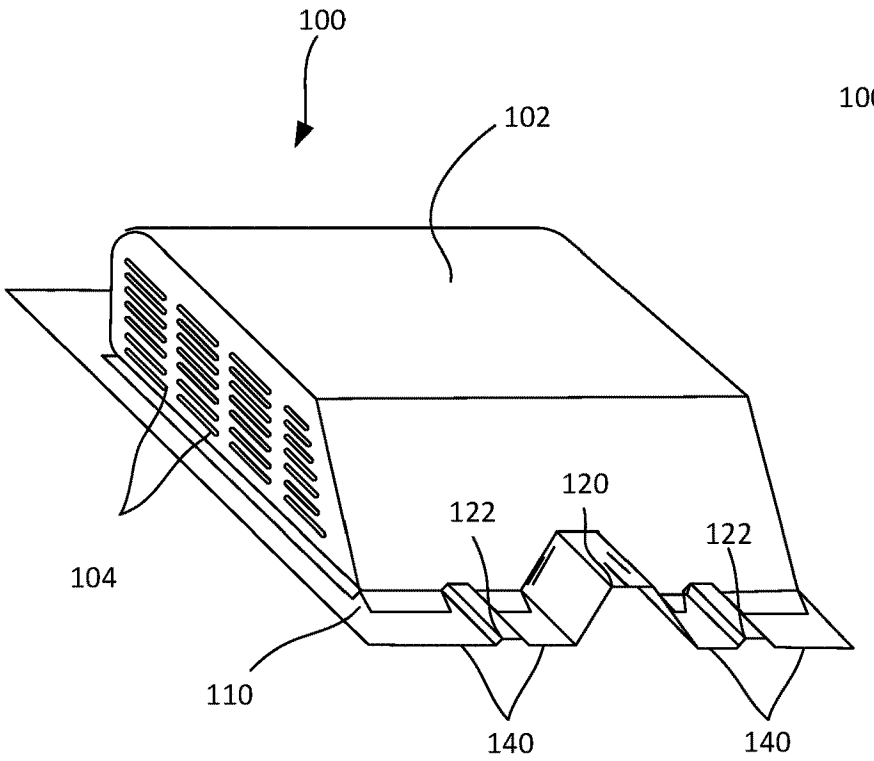

To address the difficulties in achieving an effective seal between roof vent and a contoured metal roof surface, the present disclosure is directed to a roof vent having a base or foot configured to conformably engage with a contoured metal roof. FIGS. 3, 4A and 4B illustrate one embodiment of the vent 100. As shown, the vent includes a cap 102, a foot 110 and a collar 130. When assembled, the cap 102 extends over a hollow interior (e.g., surrounds) of the collar 120. The cap 102, foot 110 and collar 130 can be formed of a variety of metals or other materials. Similar to the vent described above, the illustrated cap 102 includes an upper surface and four side surfaces that extend downward from the upper surface to define a generally hollow interior that is sized to cover the collar 120. A plurality of vent slits 104 may be formed through one or more of the walls of the cap 102. In the illustrated embodiment, a lower peripheral edge of the cap engages an upper surface of the foot 110. However, it will be appreciated that the lower peripheral edge of the cap may be spaced above the foot and that the cap may connect to the collar or the base via a plurality of legs (not shown). Such an arrangement is set forth in U.S. patent application Ser. No. 16/676,897 as incorporated above. The collar 130 forms an annular sidewall having a hollow interior. A lower edge 132 of the collar 130 attaches about a periphery of an aperture 112 in the foot 110. As above, the lower edge of the collar 120 is affixed such that the interface between the collar 120 and the foot 110 is sealed to prevent water intrusion into the foot aperture.

In contrast to the vent described above, the foot 110 of the vent 100 is contoured to matingly engage with a correspondingly contoured underlying surface (e.g., corrugated metal roof panel). In the illustrated embodiment, the contoured foot 110 is a thin sheet of material (e.g., sheet metal) having an upper or top surface and a bottom surface. In the illustrated embodiment, the foot 110 is rectangular having a forward edge 114, a rearward edge 116 and two lateral edges 118*a*, 118*b*, which collectively define a periphery of the foot. The foot 110 includes one or more ridges that extend along the length of the contoured foot between its forward edge 114 and its rearward edge 116. These ridges 120, 122 protrude above the top surface of the foot and form corresponding recesses in the bottom surface of the foot along its length between its forward and rearward edges. That is, the foot 110 includes one or more ridges 120 that extend between pan sections 140 of the foot, which in the illustrated embodiment are flat sections. It will be appreciated in other embodiments that the pan section may not be flat. However, the lower surface of each pan section 140 is typically in a common plane to permit attachment to a generally planar roof deck/surface. In this non-limiting embodiment, the contoured foot 110 is configured to engage the R-type panel of FIG. 1A. In this embodiment, the contoured foot has a primary ridge 120 and corresponding recess or channel extending between its forward edge 114 and its rearward edge 116 that is sized and shaped to engage a corresponding ridge 20 of the R-panel 10 of FIG. 1A. In addition, the foot includes two secondary ridges 122 and corresponding recesses or channels that are sized and shaped to engage corresponding pan-section ridges 22 of the R-panel 10 of FIG. 1A.

Figure 4C:
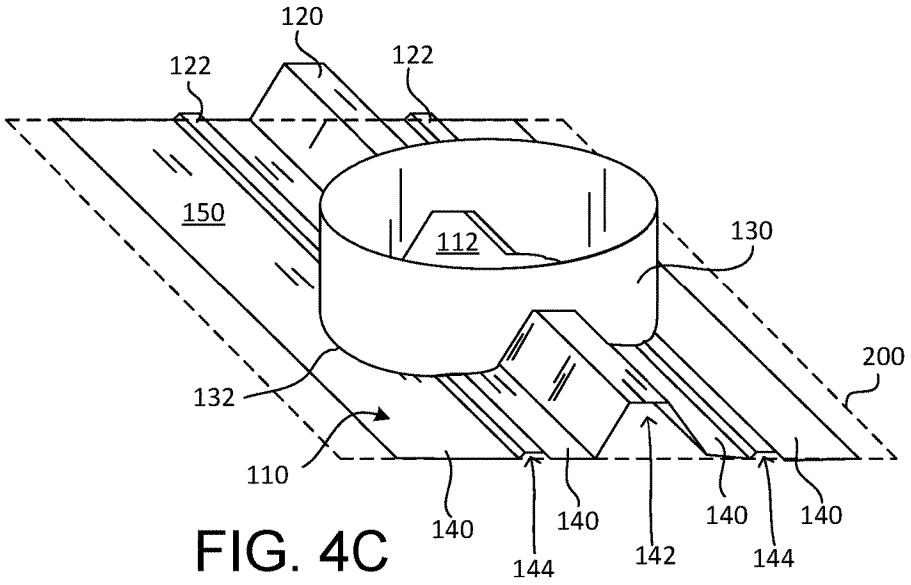
FIG. 4C illustrates top perspective view of a foot and collar of the roof vent.
Figure 4D:
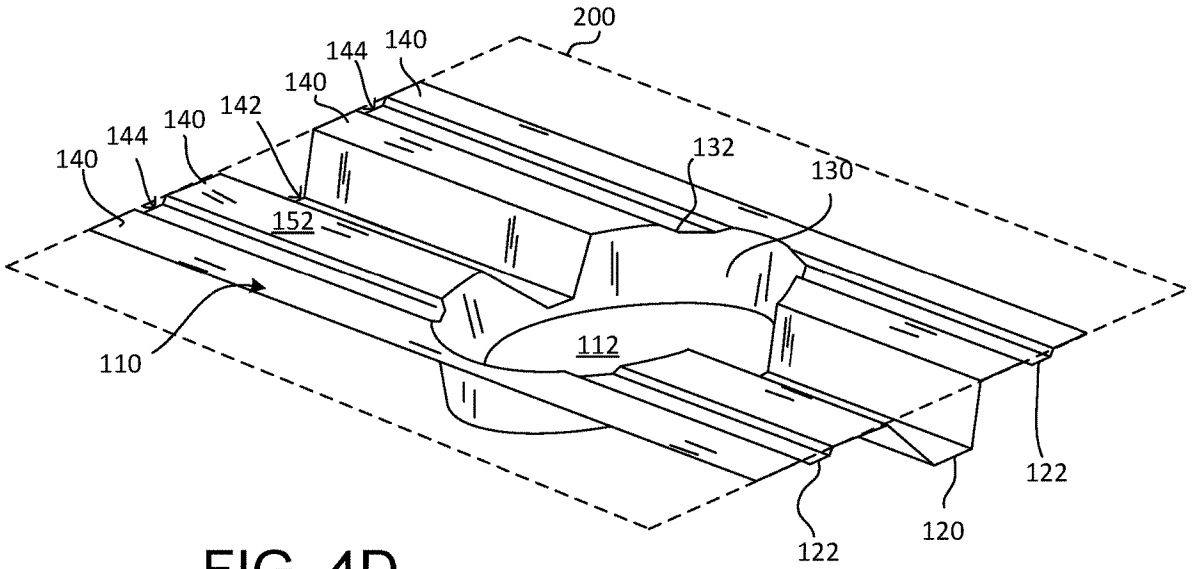
FIG. 4D illustrates a bottom perspective view of the foot and collar or the roof vent.

The contour of the foot 110 on its top surface 150 and its bottom surface 152 is best illustrated in FIGS. 4C and 4D where the vent cap is removed from the vent 100 for purposes of illustration. For further purposes of discussion, a reference plane 200 is illustrated as being aligned with the lower surfaces of the pan sections 140 of the foot 140. As illustrated, the ridges 120, 122 in addition to protruding above the top surface of the foot also form corresponding recesses or channels 142, 144, respectively, that extend between opposing edges of the foot. That is, each rib section may be considered a ridge 120 or 122 on the top surface 150 of the foot 110 as well as a channel 142 or 144 on the bottom surface 152 of the foot 110 that is recessed relative to the common reference plane 200. Further, it should be noted that while the ridges/channel may be termed as extending between opposing edges of the foot, that one or more or even all of the ridges/channels may be discontinuous. That is, the aperture 112 in the foot may be disposed along the length of some or all of the ridges/channels such that these ridges/channels have two portions or sections, one on either side of the aperture 112. As illustrated, the lower edge 132 of the collar is configured to match the contour of the ridges/recesses about the periphery of the aperture 112.

Figure 5A:
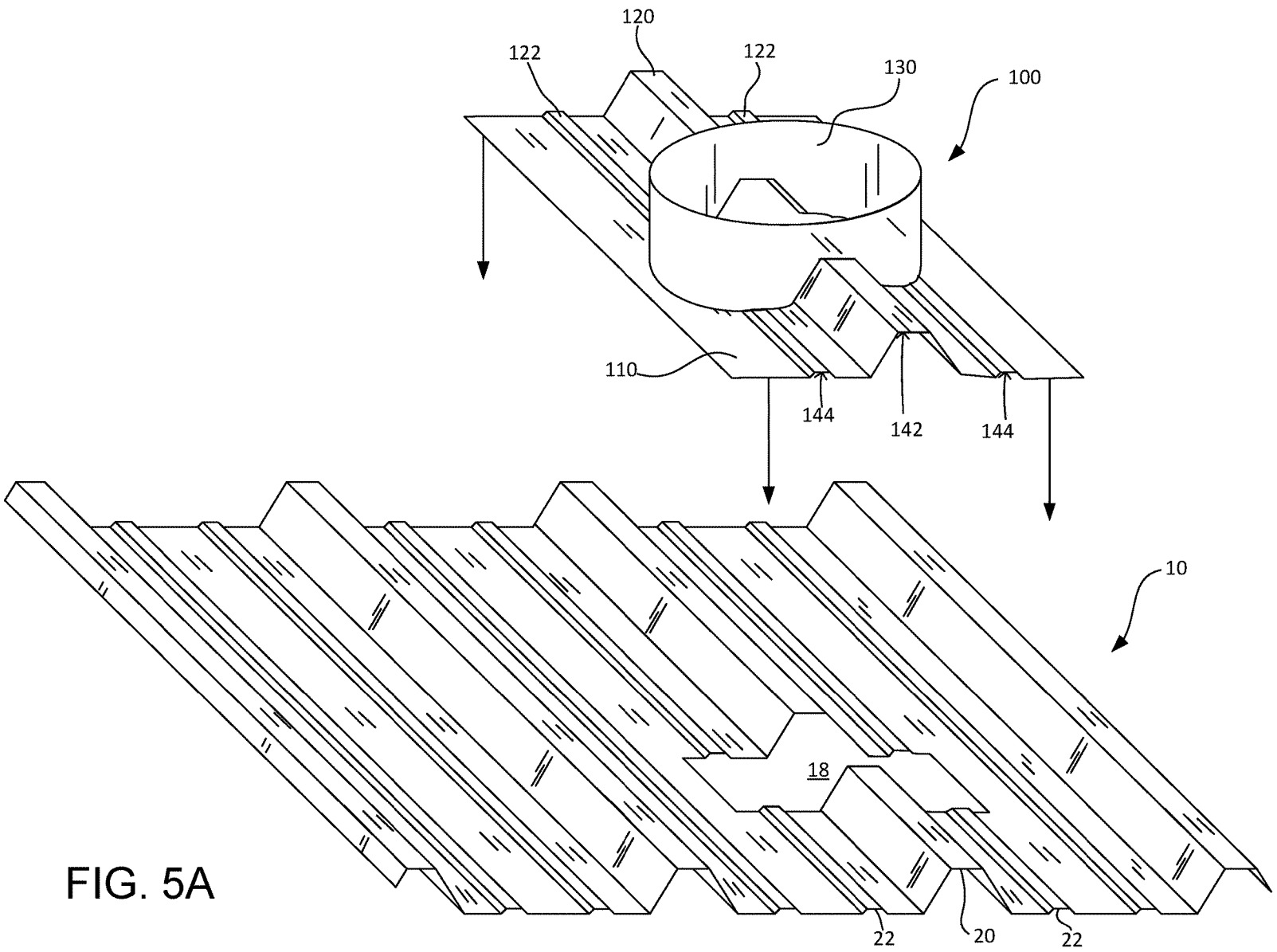
FIG. 5A illustrates positioning of the roof vent relative to a metal roof panel.
Figure 5B:
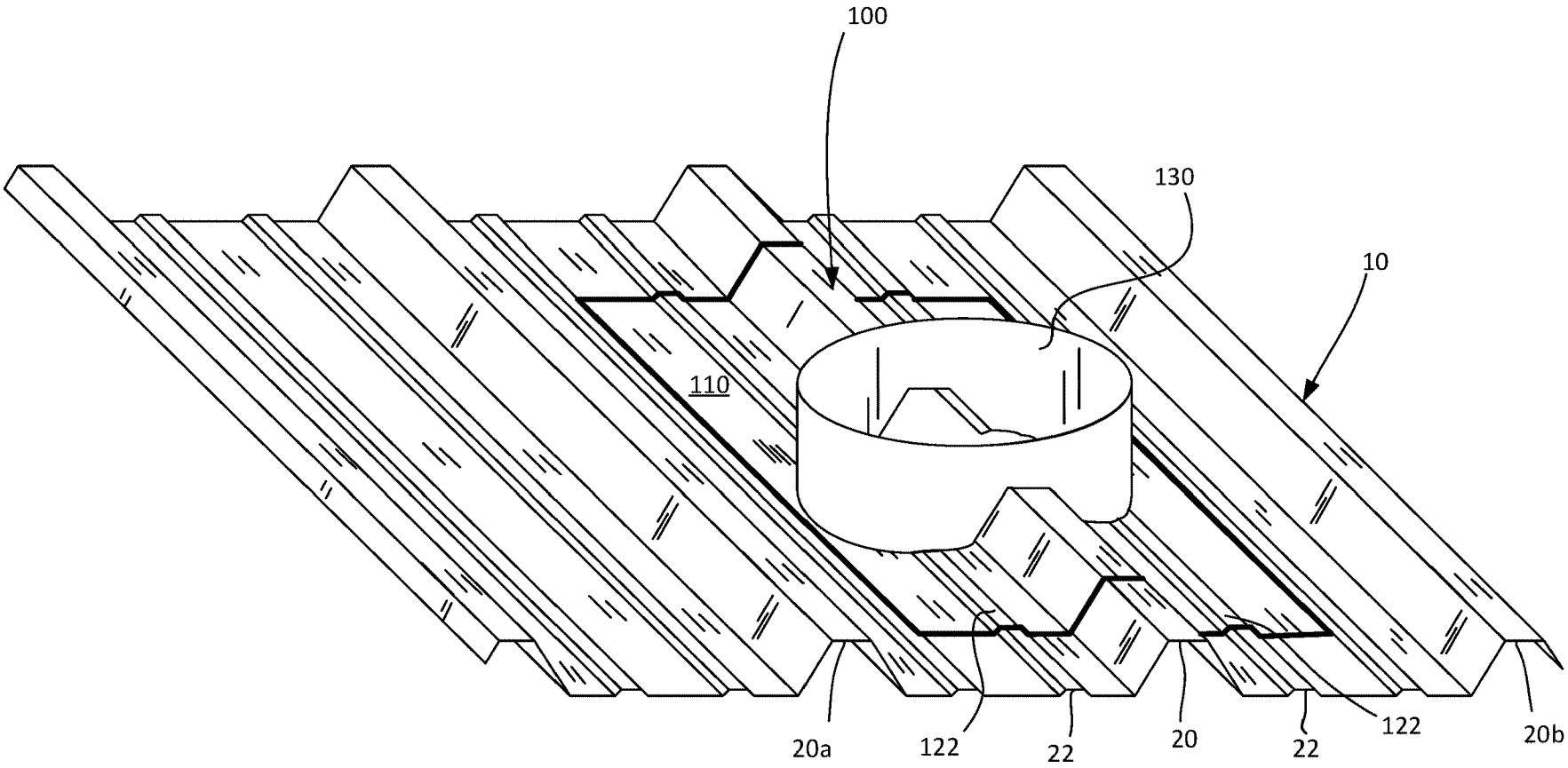
FIG. 5B illustrates the roof vent engaged against the surface of the metal roof panel.

The engagement of the contoured foot 110 of the vent 100 with an underlying metal roof panel 10 is best illustrated in FIGS. 5A and 5B. In these figures the vent cap is removed from the vent 100 for purposes of illustration. As shown in FIG. 5A, an opening 18 may be formed through the roofing panel 10. The vent 100 may be positioned such that the opening 18 will be disposed within the interior of the collar 130 when the vent 100 is applied to the surface of the metal roof panel 10. Once correctly positioned, the bottom surface of the contoured foot 110 of the vent 100 may be engaged against (e.g., compressed against) the top surface of the metal roof panel. See FIG. 5B. As shown the primary ridge 20 of the metal panel 10 is received in the channel 142 of the primary ridge 120 in the bottom surface of the contoured foot 110. Likewise, the pan section ridges 22 of the metal panel 10 are received within channels 144 of the secondary ridges 122 in the bottom surface of the contoured foot 110. As a result, the foot 110 closely fits (e.g., conformally fits) to the surface of the metal panel 10. This conformal fit allows for forming an effectively seal at the interface between the bottom surface of the vent 100 and the metal panel. Additionally, the conformal fit between the vent and the metal panel reduces the overall obtrusiveness of the vent once attached to a metal roof.

To achieve an effective seal between the bottom surface of the vent and the metal panel, the bottom surface of the vent may include a pliable waterproof coating (e.g., rubberized coating). Such a coating may be applied to the bottom surface of the vent during manufacture (i.e., prior to application to a roof). This coating may be made of any elastomeric material including, without limitation, natural and synthetic rubbers. Additionally or alternatively, a separate gasket may be disposed between the bottom surface of the vent and an upper surface of a metal roof. Such a gasket will typically include an aperture aligned with an aperture in the metal roof and the aperture in the foot of the vent. In any arrangement, metal screws may be utilized to affix the vent to the roof surface. Additionally, rubberized adhesives/sealants could be applied to the bottom surface of the vent when applied.

Of note, in various embodiments, it may be desirable that a primary ridge/channel formed into the foot 110 of the vent 100 be aligned with the center of the foot between its lateral edges 118*a*, 118*b*. See FIG. 4B. As may be appreciated, this allows the vent to straddle a ridge 20 on a metal roof surface while being positioned between two adjacent ridges 20*a*, 20*b*. See FIG. 5B. That is, aligning the ridge with a centerline of the vent and/or foot maximizes the space between bordering ridges and may allow for increasing the size of the vent and/or opening through a roof surface.

Of additional note, the collar 130 and the cap 102 may have lower edges that are contoured to match the contours of the upper surface of the contoured foot 110. As best illustrated in FIG. 4B, the lower peripheral edge 132 of the collar 130 may include notches that correspond to the ridges formed in the foot 110. Likewise, the forward and rearward ends of the cap 102 may include various notches 106 that allow the cap to conformably fit over the upper surface of the contoured foot.

Systems, methods and apparatus are provided herein. References to "preferred embodiments," "another embodiment," "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments, whether or not explicitly described. After reading the description, it will be apparent to one skilled in the relevant art how to implement the disclosure in alternative embodiments.

Furthermore, no element, component, or method step in the present disclosure is intended to be dedicated to the public regardless of whether the element, component, or method step is explicitly recited in the claims. No claim element is intended to invoke 35 U.S.C. 112(f) unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A roof vent for attachment to a contoured metal roof, comprising:

a foot having a top surface and a bottom surface and further including:

an aperture disposed within a periphery of the foot and extending through the foot between the top surface and the bottom surface;

first and second pan sections, wherein lower surfaces of the first and second pan sections are disposed in a common reference plane; and a first rib section disposed between the first and second pan sections, wherein a lower surface of the first rib section is recessed relative to the common reference plane forming a recessed channel in the bottom surface of the foot extending between opposing edges of the foot, wherein an upper surface of the first rib section forms a ridge on the top surface of the foot; and an annular collar having a lower edge affixed about a periphery of the aperture and extending above the top surface of the foot; and a cap configured to extend over a hollow interior of the collar, wherein the cap has an upper surface that extends over the hollow interior of the collar and at least one sidewall surface extending from the upper surface, wherein the sidewall surface surrounds at least a portion of the collar, wherein a lower edge of the sidewall surface of the cap attaches to the upper surface of the foot and wherein the lower edge of the sidewall surface of the cap includes at least one notch configured to receive the ridge on the top surface of the foot, and wherein a flange extends from the lower edge of the sidewall surface of the cap, and wherein the flange is sized to fit within one of the first and second pan sections.

2. The roof vent of claim 1, wherein the sidewall of the cap includes a plurality of vent slits.

3. The roof vent of claim 1, wherein the recessed channel in the bottom surface of the foot has first and second sections on opposing sides of the aperture, wherein the recessed channel is discontinuous between the opposing edges of the foot;

wherein the bottom surface of the foot has pan section channels; and wherein the pan section channels are adapted to engage pan section ridges formed in the contoured metal roof.

4. The roof vent of claim 1, wherein the lower edge of the collar affixed about the periphery of the aperture includes at least one notch configured to receive the ridge on the top surface of the foot.

5. The roof vent of claim 1, wherein an upper edge of the collar affixed about the periphery of the aperture extends further above the top surface of the foot than the ridge.

6. The roof vent of claim 1, further comprising:

a third pan section separated from the first pan section or the second pan section by a second rib section.

7. The roof vent of claim 1, wherein the foot and the annular collar are integrally formed.

8. The roof vent of claim 1, wherein the recessed channel extends between forward and rearward edges of the foot and is disposed mid-way between first and second lateral edges of the foot.

9. A roof vent for attachment to a contoured metal roof, comprising;

a foot having a top surface and a bottom surface and further including: a plurality of flat sections having lower surfaces disposed in a common reference plane;

a plurality of ridges, wherein one ridge is disposed between each pair of adjacent flat sections and wherein each ridge has an upper surface that extends above the common reference plane and a lower surface that is recessed below the common reference plane to define a recessed channel in the bottom surface of the foot that extends between opposing edges of the foot; and an aperture disposed within a periphery of the foot and extending through the foot between the top surface and the bottom surface; and an annular collar having a lower edge affixed about a periphery of the aperture and extending above the top surface of the foot; and a cap configured to extend over a hollow interior of the collar, wherein the cap has an upper surface that extends over a hollow interior of the collar and at least one sidewall surface extending from the upper surface, wherein the sidewall surface surrounds at least a portion of the collar, wherein a lower edge of the sidewall surface of the cap attaches to the top surface of the foot and wherein the lower edge of the sidewall surface of the cap includes at least one notch configured to receive a ridge of the foot, and wherein a flange extends from the lower edge of the sidewall surface of the cap, and wherein the flange is sized to fit within the recessed channel.

10. The roof vent of claim 9, wherein the plurality of ridges are parallel, and wherein each ridge has a trapezoidal shape.

11. The roof vent of claim 10, wherein at least first and second ridges of the plurality of ridges have different heights relative to the common reference plane.

12. The roof vent of claim 9, wherein at least one of the recessed channels in the bottom surface of the foot is discontinuous across the aperture;

wherein one ridge of the plurality of ridges is on the foot; and wherein the ridge of the plurality of ridges on the foot has a corresponding recess or channel that is sized and shaped to engage another ridge of a R-panel.

13. The roof vent of claim 12, wherein the lower edge of the collar affixed about the periphery of the aperture includes at least one notch configured to receive at least one ridge on the top surface of the foot.

14. The roof vent of claim 9, wherein the foot and the annular collar are integrally formed.

15. A roof vent for attachment to a contoured metal roof, comprising:

a foot having a top surface and a bottom surface and further including:

an aperture disposed within a periphery of the foot and extending through the foot between the top surface and the bottom surface;

first and second pan sections, wherein lower surfaces of the first and second pan sections are disposed in a common reference plane; and a first rib section disposed between the first and second pan sections, wherein a lower surface of the first rib section is recessed relative to the common reference plane forming a recessed channel in the bottom surface of the foot extending between opposing edges of the foot, wherein an upper surface of the first rib section forms a ridge on the top surface of the foot; and an annular collar having a lower edge affixed about a periphery of the aperture and extending above the top surface of the foot; and a cap configured to extend over a hollow interior of the collar, wherein the cap has an upper surface that extends over the hollow interior of the collar and at least one sidewall surface extending from the upper surface, wherein the sidewall surface surrounds at least a portion of the collar, wherein a lower edge of the sidewall surface of the cap attaches to the upper surface of the foot and wherein the lower edge of the sidewall surface of the cap includes at least one notch configured to receive the ridge on the top surface of the foot, wherein a flange extends from the lower edge of the sidewall surface of the cap, and wherein the flange is sized to fit within one of the first and second pan sections; and wherein the first and second pan sections are not flat.

* * * * *